United States Patent [19]

Carbonneau

[11] 3,973,606

[45] Aug. 10, 1976

[54] DEBARKING APPARATUS HAVING ANGLED DRUM SECTIONS

[75] Inventor: Marcel Carbonneau, Sherbrooke, Canada

[73] Assignee: Canadian Ingersoll-Rand Company Limited, Montreal, Canada

[22] Filed: Oct. 25, 1974

[21] Appl. No.: 517,893

[52] U.S. Cl. ..... 144/208 B

[51] Int. Cl.[2] ..... B27L 1/02

[58] Field of Search ..... 144/208 B, 311; 241/153, 163, 161

[56] References Cited

UNITED STATES PATENTS

| | | | |
|---|---|---|---|
| 1,019,111 | 3/1912 | Wright | 144/208 B |
| 1,120,636 | 12/1914 | Whitcomb | 144/208 B |
| 1,904,937 | 4/1933 | Strindlund | 144/208 B |
| 3,272,245 | 9/1966 | Dick | 144/208 B |

FOREIGN PATENTS OR APPLICATIONS

| | | | |
|---|---|---|---|
| 698,520 | 10/1940 | Germany | 241/153 |

*Primary Examiner*—Al Lawrence Smith
*Assistant Examiner*—Gary L. Smith
*Attorney, Agent, or Firm*—Bernard J. Murphy

[57] ABSTRACT

Debarking apparatus comprising a plurality of rotatable drum sections having their centerlines at different angles. The first or inlet drum section has its centerline most steeply angled for feeding logs therethrough to maintain a low level of logs therein; and the discharge drum section may have its centerline either generally horizontal or angled to the horizontal. Between the inlet and discharge drum sections, there are positioned intermediate drum sections having their centerlines at progressively lesser angles to the horizontal and also a drum section having its centerline at least generally horizontal, it being understood that the arrangement and number of such intermediate drum sections are variable in different embodiments.

17 Claims, 4 Drawing Figures

DEBARKING APPARATUS HAVING ANGLED DRUM SECTIONS

The present invention relates to drum-type debarking apparatus and more particularly to drum-type debarking apparatus including drum means comprising a plurality of end-to-end drum sections.

An object of the present invention is to provide a new and improved debarking apparatus of the type set forth wherein the drum means comprises drum sections which are particularly relatively arranged for maximizing the log load in the drum means.

Another object of the invention is to provide new and improved debarking apparatus of the type set forth wherein the drum means comprises drum sections which are particularly relatively arranged for controlling the distribution of the log load in the drum means.

Another object of the invention is to provide new and improved debarking apparatus of the type set forth wherein the drum means comprises drum sections having their centerlines at different angles.

Other objects and advantages of the invention will be apparent from the following description taken in connection with the accompanying drawing wherein, as will be understood, the preferred embodiments of the invention have been shown for the purposes of illustration only.

In accordance with the invention, debarking apparatus may comprise a plurality of end-to-end drum sections, at least one of the drum sections having its centerline angled relative to the centerline of another of the drum sections.

Referring to the drawings.

Figures 1, 2, 3:
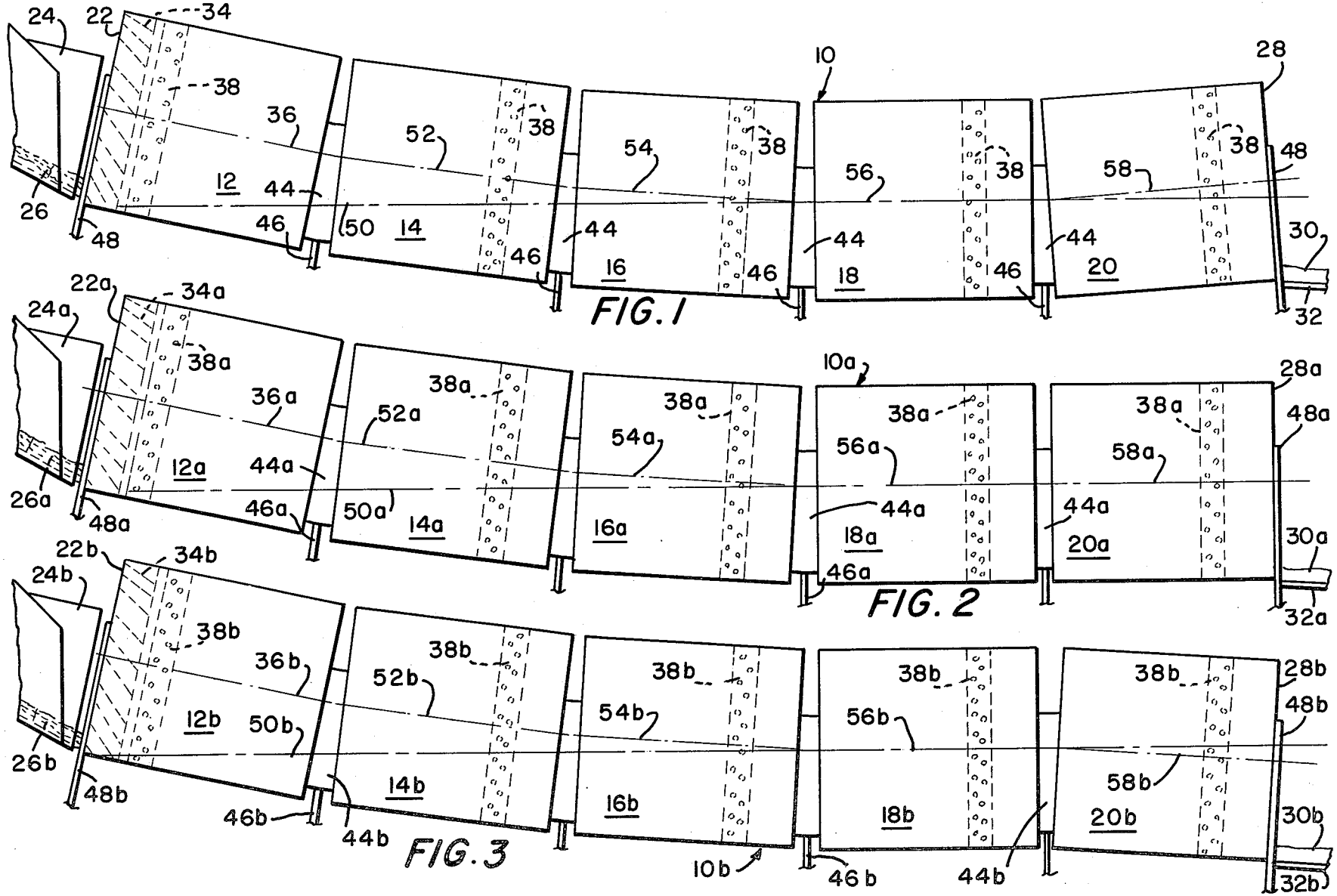
FIG. 1 is an elevational view schematically depicting one embodiment of debarking apparatus constructed in accordance with the present invention.
FIG. 2 is an elevational view schematically depicting a second embodiment of debarking apparatus constructed in accordance with the invention.
FIG. 3 is an elevational view schematically depicting a third embodiment of debarking apparatus in accordance with the invention.
Figure 4:
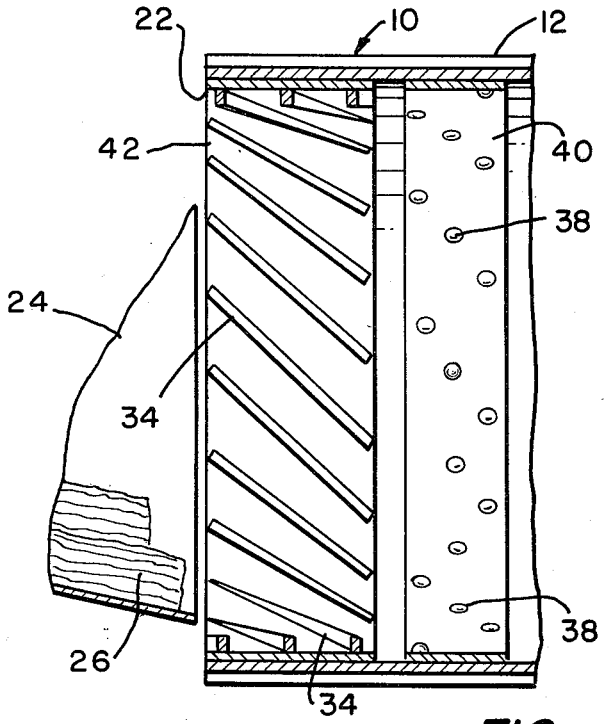
FIG. 4 is a substantially enlarged, fragmentary, elevational sectional view of the inlet end of the inlet drum section of FIG. 1 embodiment of the invention.

Referring more particularly to the drawings wherein similar reference characters designate corresponding parts throughout the several views, FIG. 1 illustrates a debarking apparatus comprising a rotatable drum means, designated generally as 10, which includes five end-to-end drums or drum sections — namely, an inlet drum section 12, a discharge drum section 20 and three therebetween intermediate drum sections 14, 16, 18 interconnecting the inlet and discharge drum sections 12, 20, it being understood that the arrangement and the number of such intermediate drum sections 14, 16, 18 are variable in different embodiments of the apparatus. The drum sections 12, 14, 16, 18, 20 are individually rotatably mounted in fixed relative positions, such as by conventional cooperative tires and trunion rollers (not shown), on the usual base pad and, throughout the operation of the debarking apparatus, are continuously rotatably driven by conventional motor means (not shown). The drum sections 12, 14, 16, 18, 20 moreover, as will be understood, include the usual bark discharge openings through wwhich the removed bark is discharged from the drum means 10.

The inlet drum section 12 includes an open inlet end 22 through which the logs to be debarked are introduced into the drum means 10; and a downwardly sloping feed chute 24 is disposed adjacent such inlet end 22 for longitudinally feeding the logs 26 to be debarked into the latter. The discharge drum section 20 includes an open discharge end 28 through which the debarked logs 30 are discharged onto a conventional discharge conveyor 32; and, throughout the length of the drum means 10, adjacent ends of adjacent ones of the drum sections 12, 14, 16, 18, 20 are in the conventional manner open to one another in spaced apart relationship whereby logs 26 introduced into the inlet end 22 of the inlet drum section 12 pass serially through the intermediate drum sections 14, 16, 18 to the discharge drum section 20 and are discharged in debarked condition through the discharge end 28 of the latter.

Adjacent to its inlet end 22, the inlet drum section 12 rigidly carries a plurality of upstanding vanes or flights 34 which are arranged at spaced locations around such inner circumference and disposed to longitudinal extend arcuately or at an angle relative to the centerline 36 of the drum section 12. The vanes 34 are illustrated as each formed from a plate contoured in a configuration of a short segment of a spiral around such centerline 36 and are each of a length to extend, longitudinally of the drum section 12, for only a minor portion of the length of the drum section 12. Further details concerning the vanes 34, if desired, can be obtained from the co-pending U.S. Pat. application Ser. No. 517,814 filed Sept. 25, 1974 entitled "Debarking Apparatus Including Log Velocity Controlling Means," which is assigned to the assignee of the present invention. Throughout the remainder of its length, the inner circumference of the drum section 12 carries debarking tools 38 particularly adapted for applying high unit pressure, localized impact blows to logs in the drum section 12. As illustrated, the debarking tools 38 are in the form of relatively blunt protrusions arcuately contoured on all working sides to prevent log damage and arranged in annular sets mounted on the drum section 12 by annular mounting rings 40. Also, as illustrated, the vanes 34 are similarly mounted on the drum section 12 by a mounting ring 42. It will be understood, however, that the tools 38 could be of other configuration and arrangement suitable to provide the described impact blows without log damage and also that the tools 38 and/or the vanes 34 could be otherwise suitably mounted on the drum section 12.

The drum sections 14, 16, 18, 20 are throughout their lengths provided with debarking tools similar to the beforedescribed debarking tools 38 carried by the inlet section 12, it being understood, however, that the debarking tools provided on the drum sections may be constructed of different sizes and/or shapes at different locations in the drum means 10 to insure adequate bark removal without log damage. For the purposes of illustration only, a single annulus of debarking tools 38 on each of the drum sections 12, 14, 16, 18, 20 has been shown in FIG. 1. An elongated anvil or log deflector 44 longitudinal extends completely through the drum means 10 and is rigidly supported by ground mounted supporting frames 46 between adjacent ones of the drum sections and by ground mounted supporting frames 48 at its ends. The anvil 44 extends through the downturning sides of the drum sections 12, 14, 16, 18, 20 at a location to prevent rimming of the logs with the lrum sections during their driven rotation, the anvil 44 ılso serving to maintain the logs in the drum sections at east generally aligned longitudinally thereof and conrol the direction in which the logs are presented to the lebarking tools 38. The anvil 44 may be of any suitable :onstruction to perform its intended functions, such as, or example, the construction described in the beforenentioned co-pending U.S. Pat. application entitled 'Debarking Apparatus Including Log Velocity Conrolling Means."

The inlet drum section 12 is mounted with its centerine 36 sloping downwardly from its inlet end 22 owards the horizontal, schematically depicted by the ine 50 shown in FIG. 1, at a relatively steep angle for acilitating the longitudinal movement of logs through he inlet section 12 to the adjacent intermediate drum ection 14. The intermediate drum section 14, in turn, ; mounted with its centerline 52 sloping downwardly owards the horizontal 50 from the inlet section 12 owards the discharge section 20, but at a lesser angle han the angle of the downward slope of the centerline 6 of the inlet section 12. The intermediate section 16 ; mounted with its centerline 54 also sloping down-vardly towards the horizontal 50 in the direction from he inlet section 12 towards the discharge section 20, ut at an angle less than the downward slope of the enterline 52 of the drum section 14. The drum section 8 is mounted with its centerline 56 at least generally orizontal; and the discharge section 20 is mounted vith its centerline 58 sloping upwardly from the inter-ıediate section 18 towards its discharge end 28. The ifference between the slope of the centerlines of adjaent ones of the drum sections is, of course, variable in ifferent embodiments of the invention; however, it is elieved that the difference in the slope between the enterlines of adjacent ones of the drum sections hould not be substantially greater than about six derees.

Throughout the operation of the beforedescribed ebarking apparatus, the drum sections 12, 14, 16, 18, 0 are continuously rotatably driven in the same direc-ion about their respective centerlines while logs 26 are ed into the inlet end 22 of the inlet section 12 and ebarked logs 30 are discharged from the discharge nd 28 of the discharge section 20. The anvil 44 serves ) prevent logs within the drum sections from being arried circumferentially around the latter by their riven rotation, while also cooperating with the vanes 4 to align the logs 26 supplied through the inlet end 24 ı the longitudinal direction of the drum means 10 and ıaintaining the logs within the drum means 10 aligned t least generally longitudinally of the latter. In addion, the anvil 44 serves to control the direction in hich the logs are supplied to the debarking tools 38 arried by the drum sections. The vanes 34 also serve ) control the velocity of the log movement longitudially of the drum means 10 in the manner described in ıe beforementioned co-pending U.S. patent applicaon.

The relatively steep downward slope of the centerline 6 of the inlet section 12 causes the inlet section 12 to ssist in longitudinally advancing the logs through the rum means 10 and the downwardly sloping centerlines 2, 54 of the drum sections 14, 16 also cause the latter ) facilitate such log movement longitudinally of the rum means 10. Moreover, due to such downwardly oping centerlines 36, 52, 54 a relatively great depth of ıgs can be maintained in the drum sections 14, 16, 18 while a substantially lesser depth of logs is maintained in the inlet section 12 (for example, in debarking apparatus wherein the drum sections are all of 8 foot diameter, a 4 foot depth of logs can be maintained in the drum sections 14, 16, 18 while only a 1 foot depth of logs is maintained in the inlet section 12). In addition, the log level in the discharge section 20 can be maintained sufficiently low for proper discharge of debarked logs 30 through its discharge end 28 — for example, in the beforementioned debarking apparatus including a 8 foot diameter drum sections, the depth of logs in the discharge section 20 can be maintained at 2 feet or lower. Hence, the loading off the drum means 10 is resultantly maximized while still remaining desirable, relatively low levels of logs in the inlet and discharge sections 12, 20.

FIG. 2, wherein parts corresponding to those beforedescribed are designated by the corresponding reference numeral followed by the suffix "a," illustrates an embodiment of the debarking apparatus identical to that of FIG. 1 except that the centerline of **58*a* of the discharge section 20*a*** is on an axis at least generally horizontal.

FIG. 3, wherein parts corresponding to those beforedescribed are designated by the corresponding reference numeral followed by the suffix "*b*", illustrates an embodiment of the debarking apparatus identical to that of FIG. 1 except that the centerline **58*b* of the discharge section 20*b* slopes downwardly from the preceding drum section 18*b* towards its discharge end 28*b*.**

The operation of the FIG. 2 and 3 embodiment of the invention is believed to be apparent from the preceding description of the FIG. 1 embodiment.

From the preceding description, it will be seen that the invention provides new and improved means for attaining all of the beforedescribed objects and advantages. It will be understood, however, that, although only three embodiments of the invention have been illustrated and specifically hereinbeforedescribed, the invention is not limited to merely these three embodiments, but rather contemplates other embodiments and variations within the scope of the following claims.

Having thus described my invention, I claim:

1. Debarking apparatus comprising a plurality of end-to-end rotatable drum sections mounted to be rotatably driven in fixed relative positions during operation of the apparatus, including means supporting at least one of said drum sections with its centerline angled relative to the centerline of another said drum sections, and causing said one drum section to have a different log-depth retention capacity than said another drum section, wherein there are at least three of said drum sections, one of said drum sections being an inlet drum section through which logs are introduced into the debarking apparatus, a second of said drum sections being a discharge drum section from which logs are discharged from the debarking apparatus, and a third of said drum sections being an intermediate drum section intermediate and interconnecting said inlet and discharge drum sections, said inlet drum section having its centerline angled downwardly at a first angle to the horizontal, and said intermediate drum section having its centerline angled downwardly at a second angle, less than said first angle, to the horizontal.

2. Debarking apparatus according to claim 1, wherein said discharge drum section has its centerline at least generally horizontal.

3. Debarking apparatus according to claim 1, wherein said discharge drum section has its centerline at an angle to the horizontal.

4. Debarking apparatus according to claim 1, further comprising at least one additional rotatable drum section between and interconnecting said intermediate and discharge drum sections, said additional drum section having its centerline at least generally horizontal.

5. Debarking apparatus comprising rotatable drum means including a plurality of end-to-end rotatable drum sections mounted to be rotatably driven in fixed relative positions during operation of the apparatus, one of said drum sections being an inlet drum section having an inlet end through which logs are introduced into the debarking apparatus, another of said drum sections being a discharge drum section having a discharge end from which logs are discharged from the debarking apparatus, and a third of said drum sections being an intermediate drum section intermediate and interconnecting said inlet and discharge drum sections, including first means supporting said inlet drum section with its centerline angled downwardly at a first angle as it extends from its said inlet end, and including second means supporting said intermediate drum section with its centerline angled downwardly at a second angle, less than said first angle, as it extends from said inlet drum section toward said discharge drum section, wherein said first and second means comprising means for causing said one and another drum sections to have different log-depth retention capacities.

6. Debarking apparatus according to claim 5, wherein said discharge drum section has its centerline at least generally horizontal.

7. Debarking apparatus according to claim 5, wherein said discharge drum section has its centerline angled upwardly towards its said discharge end.

8. Debarking apparatus according to claim 5, wherein said discharge drum section has its centerline angled downwardly towards its said discharge end.

9. Debarking apparatus according to claim 5, wherein said downwardly angling of the centerline of said inlet drum section is sufficient to maintain only a relatively low level of logs therein.

10. Debarking apparatus according to claim 9, wherein said downward angling of the centerline of said intermediate drum section is such as to maintain a substantially higher level of logs in said intermediate drum section than in said inlet drum section.

11. Debarking apparatus according to claim 5, further comprising at least one additional rotatable drum section between said intermediate drum section and discharge drum section, said additional drum section having its centerline angled relative to the horizontal.

12. Debarking apparatus according to claim 11, wherein said additional drum section has its centerline angled downwardly as it extends toward said discharge drum section.

13. Debarking apparatus according to claim 5, further comprising at least one additional rotatable drum section between said intermediate drum section and said discharge drum section, said addtional drum section having its centerline at least generally horizontal.

14. Debarking apparatus according to claim 5, wherein there are a plurality of said intermediate rotatable drum sections between said inlet drum section and said discharge drum section, said plurality of drum sections having their centerlines at different angles to the horizontal.

15. Debarking apparatus according to claim 14, wherein such angles of the centerlines of said plurality of intermediate drum sections are progressively lesser angles from said inlet drum section towards the discharge drum section.

16. Debarking apparatus according to claim 14, further comprising an additional rotatable drum section intermediate said plurality of drum sections and said discharge drum section, said additional drum section having its centerline at least generally horizontal.

17. Debarking apparatus according to claim 5, wherein the difference between the slope of the centerline of adjacent ones of said drum sections is not greater than about 6 °.

* * * * *